US010837413B2

(12) United States Patent
Patel et al.

(10) Patent No.: US 10,837,413 B2
(45) Date of Patent: Nov. 17, 2020

(54) AIR DELIVERY SYSTEM FOR AN ENGINE

(71) Applicant: Caterpillar Inc., Deerfield, IL (US)

(72) Inventors: Kalpeshbhai Ghanshyambhai Patel, Streamwood, IL (US); Qinyang Rao, Washington, IL (US); Dallas James Coffey, Naperville, IL (US); Amit Kashyap, Elgin, IL (US); Daniel Unger, Yorkville, IL (US)

(73) Assignee: Caterpillar Inc., Peoria, IL (US)

( * ) Notice: Subject to any disclaimer, the term of this patent is extended or adjusted under 35 U.S.C. 154(b) by 85 days.

(21) Appl. No.: 16/018,129

(22) Filed: Jun. 26, 2018

(65) Prior Publication Data

US 2019/0390635 A1 Dec. 26, 2019

(51) Int. Cl.

| | |
|---|---|
| ***F02M 35/024*** | (2006.01) |
| ***F02M 35/10*** | (2006.01) |
| ***F02M 35/02*** | (2006.01) |
| ***F02M 35/16*** | (2006.01) |

(52) U.S. Cl.

CPC .. *F02M 35/02433* (2013.01); *F02M 35/0215* (2013.01); *F02M 35/0216* (2013.01); *F02M 35/02416* (2013.01); *F02M 35/10045* (2013.01); *F02M 35/10052* (2013.01); *F02M 35/10078* (2013.01); *F02M 35/10144* (2013.01); *F02M 35/164* (2013.01)

(58) Field of Classification Search

CPC ..... F02M 35/02433; F02M 35/02416; F02M 35/0215; F02M 35/0216; F02M 35/10045; F02M 35/10052; F02M 35/10078; F02M 35/10144; F02M 35/164

See application file for complete search history.

(56) References Cited

U.S. PATENT DOCUMENTS

| | | | | |
|---|---|---|---|---|
| 6,131,392 | A | 10/2000 | Baldwin et al. | |
| 2007/0289268 | A1* | 12/2007 | Smith | B01D 46/002 55/385.3 |
| 2016/0151731 | A1* | 6/2016 | Crary | B01D 46/0005 29/401.1 |
| 2016/0228804 | A1 | 8/2016 | Hasenfratz et al. | |
| 2017/0216749 | A1* | 8/2017 | Hasenfratz | B01D 46/002 |

FOREIGN PATENT DOCUMENTS

| | | |
|---|---|---|
| CN | 202117812 | 1/2012 |
| CN | 202811124 | 3/2013 |
| CN | 203570472 | 4/2014 |
| DE | 102006032716 | 1/2008 |
| EP | 1741919 | 4/2009 |
| JP | 2011080421 | 4/2011 |

* cited by examiner

*Primary Examiner* — Jacob M Amick

(74) *Attorney, Agent, or Firm* — Miller, Matthias & Hull LLP

(57) ABSTRACT

An air delivery system for an engine includes a first air filter, a second air filter, a first conduit, a second conduit, an air box, and a third conduit. Each of the first air filter and the first conduit, and each of the second air filter and the second conduit are disposed at a first angle with respect to a lateral axis of the air box. The first angle is adapted to limit restriction to flow of intake air from each of the first air filter and the second air filter toward the air box. The third conduit is disposed at a second angle with respect to a longitudinal axis of the air box. The second angle is adapted to limit restriction to the flow of intake air from the air box to the engine.

19 Claims, 6 Drawing Sheets

AIR DELIVERY SYSTEM FOR AN ENGINE

TECHNICAL FIELD

The present disclosure relates to an air delivery system. More particularly, the present disclosure relates to the air delivery system associated with an engine.

BACKGROUND

An internal combustion engine includes an air filter to filter flow of intake air delivered to the engine. In many applications, a dual filter design may be employed in order to provide increased intake air flow, based on a size and rating of the engine. In such a situation, multiple conduits may be used in association with an air box to combine the flow of intake air from each of the filters before being supplied to the engine. However, such a system configuration may add restriction to the flow of intake air.

For example, in some applications, an air box may be employed downstream of the dual filters in order to combine the flow of intake air from each of the filters. However, the air box may provide restriction to the flow of intake air from the dual filters toward the engine. In some applications, the multiple conduits provided downstream of the dual filters may include multiple bends. Each of the multiple bends may add restriction to the flow of intake air toward the engine.

The restriction to the flow of intake air results in increased pressure drop downstream of the filters, in turn, resulting in reduced intake air flow rate, reduced filter life, reduced fuel efficiency, reduced engine performance, increased service intervals, and increased engine/machine downtime. Hence, there is a need for an improved air delivery system for such applications.

U.S. Pat. No. 6,131,392 describes an internal combustion engine having a combustion cylinder and a turbocharger with a compressor for a combustion fluid which is introduced into the combustion cylinder. The compressor has a discharge outlet. An air duct is connected with the combustion cylinder for providing the combustion fluid to the combustion cylinder. The air duct has an inlet opening. An air pipe interconnects the compressor with the air duct. The air pipe has a first end connected with the discharge outlet of the compressor and a second end connected with the inlet opening of the air duct. The second end includes an outwardly projecting shoulder. A flange disposed around the second end of the air pipe includes a recess capturing the shoulder therein and an axial face attached directly with the air duct.

SUMMARY OF THE DISCLOSURE

In an aspect of the present disclosure, an air delivery system for an engine is provided. The air delivery system includes a first air filter. The air delivery system includes a second air filter. The air delivery system includes a first conduit provided in fluid communication with the first air filter. The air delivery system includes a second conduit provided in fluid communication with the second air filter. The air delivery system also includes an air box provided in fluid communication with each of the first conduit and the second conduit. The air box is adapted to receive flow of intake air from each of the first air filter and the second air filter. The air box defines a lateral axis and a longitudinal axis thereof. The air delivery system further includes a third conduit provided in fluid communication with the air box and the engine. The third conduit is adapted to provide the flow of intake air from the air box to the engine. Each of the first air filter and the first conduit, and each of the second air filter and the second conduit are disposed at a first angle with respect to the lateral axis of the air box. The first angle is adapted to limit restriction to the flow of intake air from each of the first air filter and the second air filter toward the air box. The third conduit is disposed at a second angle with respect to the longitudinal axis of the air box. The second angle is adapted to limit restriction to the flow of intake air from the air box to the engine.

In another aspect of the present disclosure, an engine is provided. The engine includes an engine block. The engine includes a plurality of cylinders disposed within the engine block. The engine includes a cylinder head provided in association with the engine block. The engine also includes an intake manifold provided in association with the cylinder head. The engine further includes an air delivery system provided in association with the intake manifold. The air delivery system includes a first an filter. The air delivery system includes a second air filter. The air delivery system includes a first conduit provided in fluid communication with the first air filter. The air delivery system includes a second conduit provided in fluid communication with the second air filter. The air delivery system also includes an air box provided in fluid communication with each of the first conduit and the second conduit. The air box is adapted to receive flow of intake air from each of the first air filter and the second air filter. The air box defines a lateral axis and a longitudinal axis thereof. The air delivery system further includes a third conduit provided in fluid communication with the air box and the engine. The third conduit is adapted to provide the flow of intake air from the air box to the engine. Each of the first air filter and the first conduit, and each of the second air filter and the second conduit are disposed at a first angle with respect to the lateral axis of the air box. The first angle is adapted to limit restriction to the flow of intake air from each of the first air filter and the second air filter toward the air box. The third conduit is disposed at a second angle with respect to the longitudinal axis of the air box. The second angle is adapted to limit restriction to the flow of intake air from the air box to the engine.

In yet another aspect of the present disclosure, a machine is provided. The machine includes a frame. The machine includes a plurality of ground engaging members mounted to the frame. The machine includes an implement movably mounted to the frame. The machine also includes an engine mounted on the frame. The machine further includes an air delivery system mounted on the frame and provided in association with the engine. The air delivery system includes a first air filter. The air delivery system includes a second air filter. The air delivery system includes a first conduit provided in fluid communication with the first air filter. The air delivery system includes a second conduit provided in fluid communication with the second air filter. The air delivery system also includes an air box provided in fluid communication with each of the first conduit and the second conduit. The air box is adapted to receive flow of intake air from each of the first air filter and the second air filter. The air box defines a lateral axis and a longitudinal axis thereof. The air delivery system further includes a third conduit provided in fluid communication with the air box and the engine. The third conduit is adapted to provide the flow of intake air from the air box to the engine. Each of the first air filter and the first conduit, and each of the second air filter and the second conduit are disposed at a first angle with respect to the lateral axis of the air box. The first angle is adapted to limit restriction to the flow of intake air from each of the first air filter and the second air filter toward the air box. The third conduit is disposed at a second angle with respect to the longitudinal axis of the air box. The second angle is adapted to limit restriction to the flow of intake air from the air box to the engine.

Other features and aspects of this disclosure will be apparent from the following description and the accompanying drawings.

DETAILED DESCRIPTION

Figure 1:
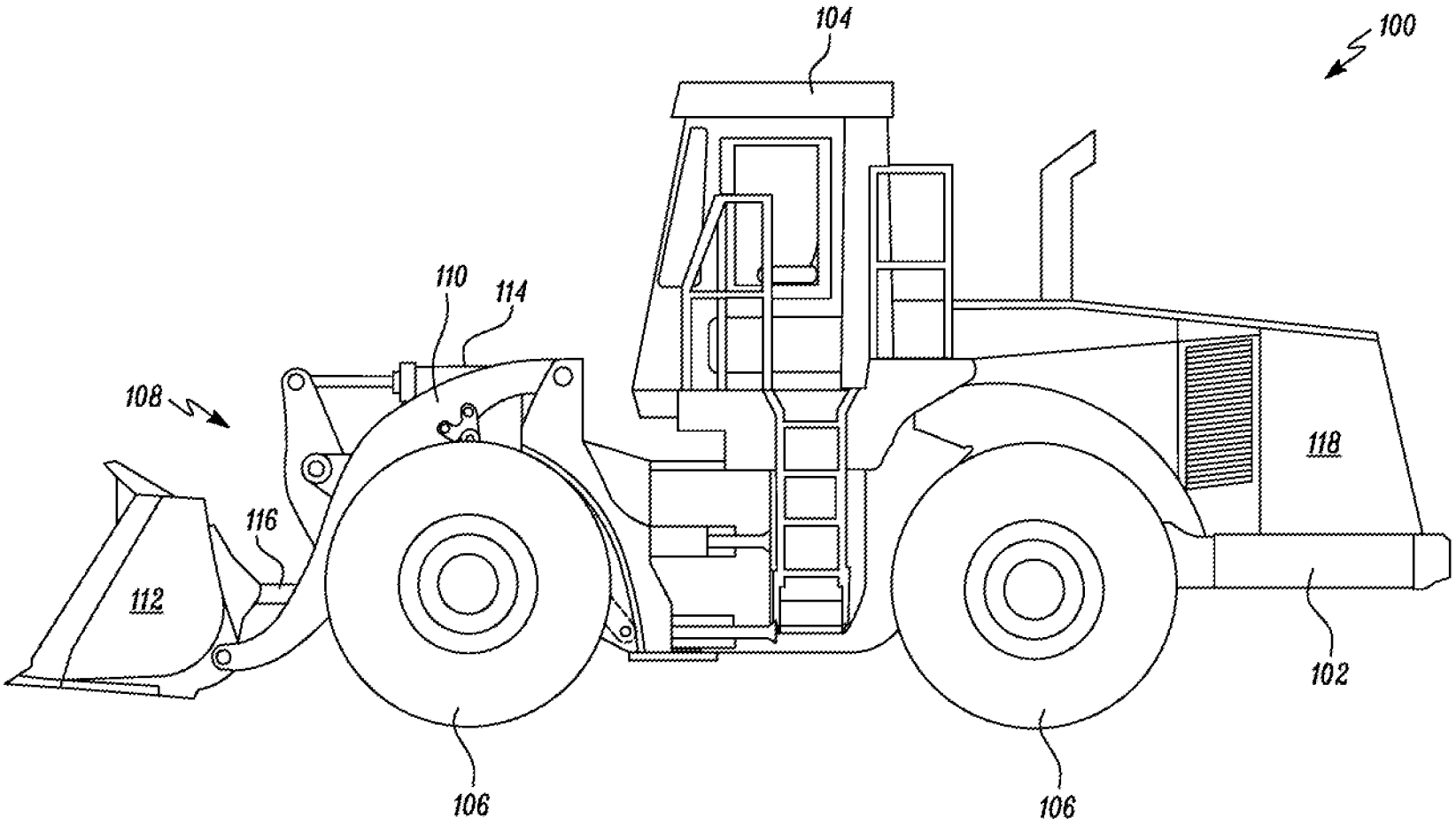
FIG. 1 is a side view of an exemplary machine, according to one embodiment of the present disclosure.

Wherever possible, the same reference numbers will be used throughout the drawings to refer to the same or the like parts. Referring to FIG. 1, a side view of an exemplary machine 100 is illustrated. More specifically, the machine 100 is a wheel loader. In other embodiments, the machine 100 may be any other machine, such as a backhoe loader, a motor grader, a truck, a tractor, a dozer, an excavator, a generator, a locomotive, and the like. The machine 100 may be adapted to perform activities, such as excavation, demolishment, transportation, material handling, and the like. In other embodiments, the machine 100 may be any machine related to an industry including, but not limited to, transportation, construction, manufacturing, power generation, material handling, marine, aviation, and aerospace.

The machine 100 includes a frame 102. The frame 102 is adapted to support various components of the machine 100 thereon. The machine 100 includes an operator cabin 104 mounted on the frame 102. The operator cabin 104 is adapted to house various controls (not shown) of the machine 100 including, but not limited to, a steering, levers, pedals, joysticks, buttons, a control interface, audio video devices, and an operator seat. The controls are configured to operate and control the machine 100. The machine 100 also includes a number of ground engaging members 106 mounted to the frame 102. In the illustrated embodiment, each of the ground engaging members 106 is a wheel rotatably mounted to the frame 102. The wheels are adapted to support and provide mobility to the machine 100 on ground. In other embodiments, the ground engaging members 106 may be tracks.

The machine 100 includes an arm assembly 108. The arm assembly 108 includes an arm 110 movably coupled to the frame 102. The arm assembly 108 includes an implement 112, such as a bucket, movably coupled to the arm 110. In other embodiments, the arm assembly 108 may include any other implement, such as a blade, based on application requirements. The arm assembly 108 also includes one or more hydraulic cylinders 114, 116 adapted to provide movement to the arm 110 and the implement 112. The arm assembly 108 is adapted to perform activities, such as excavation, demolishment, transportation, material handling, and the like, based on application requirements.

The machine 100 also includes an enclosure 118 mounted on the frame 102. The enclosure 118 is adapted to enclose an engine system 202 (shown in FIG. 2) therein. The engine system 202 is adapted to provide power to the machine 100 for operational requirements. Additionally, the enclosure 118 may enclose other components or systems (not shown) of the machine 100, such as a battery, a motor, an engine control system, a transmission system, a drive control system, a safety system, and the like, based on application requirements.

Figure 2:
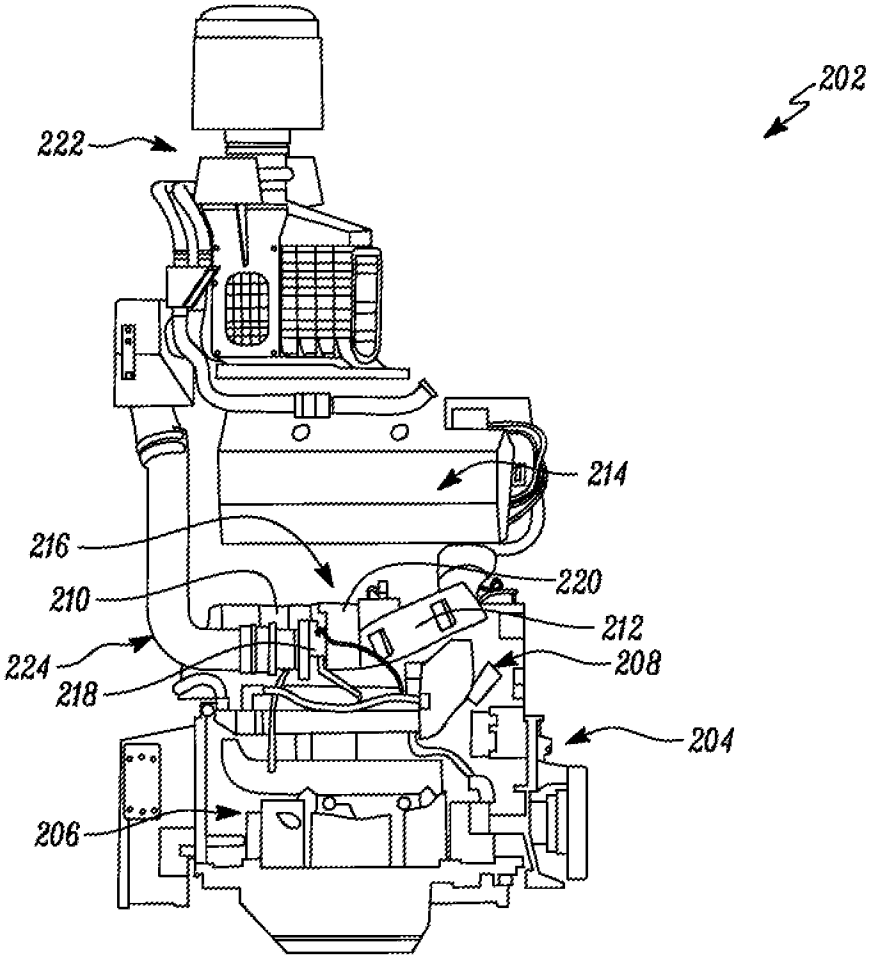
FIG. 2 is a side view of an engine system of the machine of FIG. 1, according to one embodiment of the present disclosure.

Referring to FIG. 2, a side view of an exemplary engine system 202 is illustrated. The engine system 202 includes an engine 204. The engine 204 is an internal combustion engine powered by a fuel, such as diesel, gasoline, natural gas, and/or a combination thereof. The engine 204 includes an engine block 206. The engine block 206 may include one or more cylinders (not shown) provided therein. The cylinders may be arranged in any configuration including, but not limited to, an inline, radial, and "V", among others. Each of the cylinders is adapted to receive a piston (not shown) therein.

The engine 204 also includes a cylinder head 208 mounted on the engine block 206. The cylinder head. 208 may house one or more components and/or systems (not shown) of the engine 204, such as a valve train, and sensors, among others. The engine 204 also includes an intake manifold 210 mounted on the cylinder head 208. The intake manifold 210 is fluidly coupled to the cylinders. The intake manifold 210 is adapted to provide a passage for flow of intake air into the cylinders.

The engine 204 includes an exhaust manifold 212 mounted on the cylinder head 208. The exhaust manifold 212 is fluidly coupled to the cylinders. The exhaust manifold 212 is adapted to provide a passage for flow of exhaust gas out of the cylinders. The engine system 202 includes an aftertreatment system 214. The aftertreatment system 214 is fluidly coupled to the exhaust manifold 212. The aftertreatment system 214 is adapted to treat the exhaust gas received from the engine 204 prior to release to the atmosphere. Accordingly, the aftertreatment system 214 may include one or more components (not shown), such as a particulate filter, a Selective Catalytic Reduction (SCR) unit, a Diesel Exhaust Fluid (DEF) unit, a Diesel Oxidation Catalyst (DOC) unit, and the like, based on application requirements.

The engine system 202 includes a turbocharger 216. The turbocharger 216 includes a compressor section 218 and a turbine section 220. The compressor section 218 is fluidly coupled to the intake manifold 210. The turbine section 220 is fluidly coupled to the exhaust manifold 212. The turbocharger 216 is adapted to compress the flow of intake air and deliver the compressed flow of intake air to each of the cylinders via the intake manifold 210. Additionally, the engine system 202 may include various other components and/or systems (not shown) including, but not limited to, a crankcase, a fuel system, a cooling system, a lubrication system, an exhaust gas recirculation system, and peripheries, among others.

Figure 3:
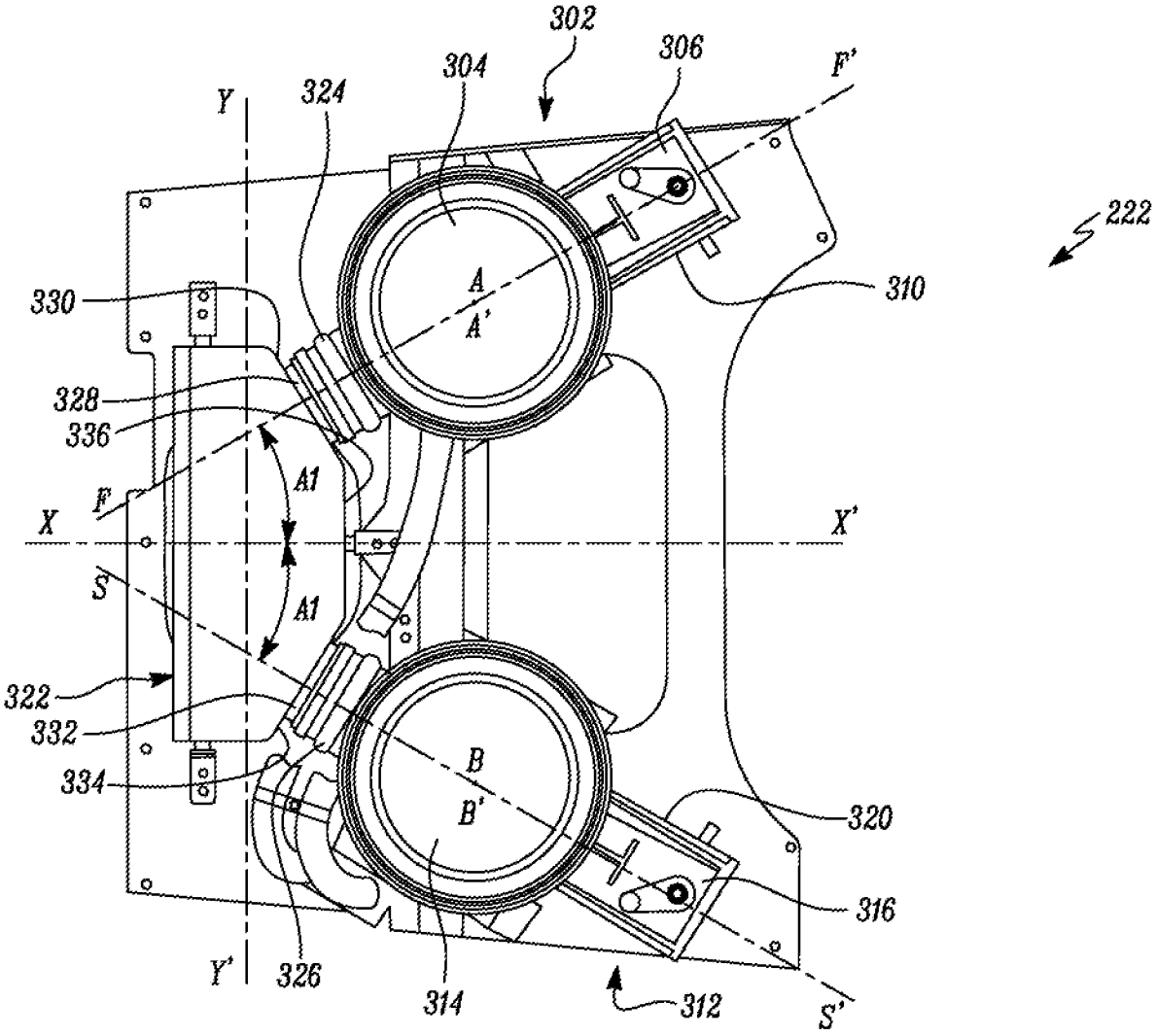
FIG. 3 is a top view of an air delivery system of the engine system of FIG. 2, according to one embodiment of the present disclosure.
Figure 4:
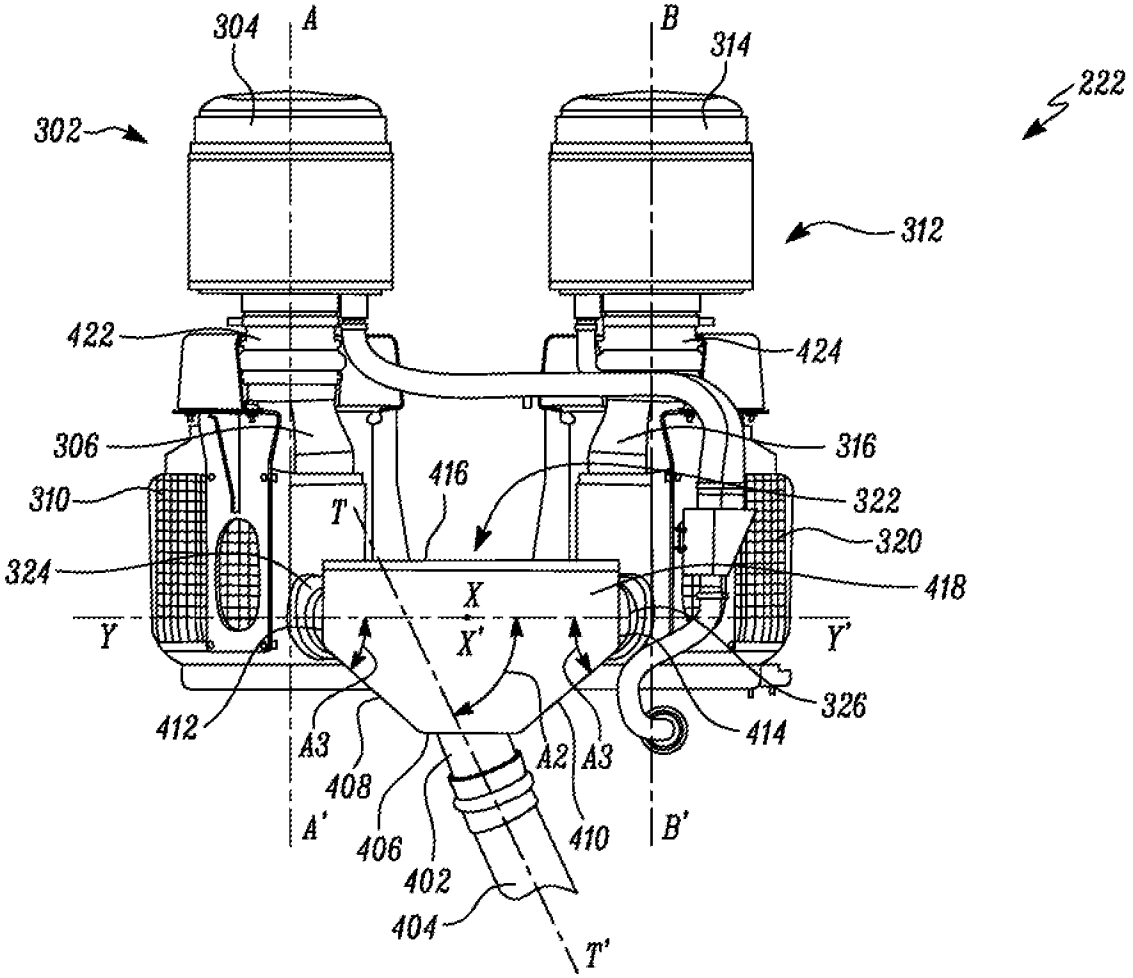
FIG. 4 is a rear view of the air delivery system of FIG. 3, according to one embodiment of the present disclosure.

The engine system 202 also includes an air delivery system 222. The air delivery system 222 is adapted to provide filtration of the flow of intake air to be delivered to the engine 204. The air delivery system 222 is fluidly coupled to the intake manifold 210 via the compressor section 218 of the turbocharger 216. In some embodiments, when the turbocharger 216 may be omitted, such as in a naturally aspirated engine, the air delivery system 222 may be directly coupled to the intake manifold 210. Referring to FIGS. 3 and 4, a top view and a rear view, respectively, of the air delivery system 222 is illustrated. The air delivery system 222 will be now explained with combined reference to FIGS. 3 and 4.

The air delivery system 222 includes a first filter assembly 302. The first filter assembly 302 includes a first pre-cleaner 304. The first pre-cleaner 304 defines a first auxiliary axis A-A'. The first pre-cleaner 304 includes a filter element (not shown) provided therein. The first pre-cleaner 304 is adapted to receive ambient air and provide partial filtration of the ambient air flowing therethrough. The first pre-cleaner 304 may be mounted on the machine 100 in a manner to be exposed to the atmosphere, such as on the enclosure 118 (shown in FIG. 1), or within the enclosure 118 but extending out of the enclosure 118, and the like. In the illustrated embodiment, the first pre-cleaner 304 has a substantially cylindrical configuration. In other embodiments, the first pre-cleaner 304 may have any other configuration, such as elliptical or rectangular.

The first filter assembly 302 includes a first plenum 306. The first plenum 306 is axially aligned with respect to the first auxiliary axis A-A'. In the illustrated embodiment, the first plenum 306 is fluidly coupled to the first pre-cleaner 304 via a first intermediate conduit 422 (shown in FIG. 4). In other embodiments, the first pre-cleaner 304 may be directly coupled to the first plenum 306. In such a situation, the first intermediate conduit 422 may be omitted. The first plenum 306 has a substantially hollow, chamber like configuration. The first plenum 306 is adapted to receive the flow of intake air from the first pre-cleaner 304.

The first filter assembly 302 also includes a first air filter 310. The first air filter 310 is axially aligned with respect to the first auxiliary axis A-A'. The first air filter 310 includes a filter element (not shown) therein. The first air filter 310 is adapted to receive the flow of intake air from the first plenum 306 and provide further filtration of the flow of intake air. In the illustrated embodiment, the first air filter 310 has a substantially rectangular configuration. In other embodiments, the first air filter 310 may have any other configuration, such as cylindrical. The first air filter 310 is mounted within the enclosure 118 of the machine 100.

The air delivery system 222 also includes a second filter assembly 312. The second filter assembly 312 is substantially similar to the first filter assembly 302. The second filter assembly 312 includes a second pre-cleaner 314. The second pre-cleaner 314 defines a second auxiliary axis B-B'. The second auxiliary axis B-B' is substantially parallel and spaced apart with respect to the first auxiliary axis A-A'. The second pre-cleaner 314 includes a filter element (not shown) provided therein. The second pre-cleaner 314 is adapted to receive ambient air and provide partial filtration of the ambient air flowing therethrough. The second pre-cleaner 314 may be mounted on the machine 100 in a manner to be exposed to the atmosphere, such as on the enclosure 118, or within the enclosure 118 but extending out of the enclosure 118, and the like. In the illustrated embodiment, the second pre-cleaner 314 has a substantially cylindrical configuration. In other embodiments, the second pre-cleaner 314 may have any other configuration, such as elliptical or rectangular.

The second filter assembly 312 includes a second plenum 316. The second plenum 316 is axially aligned with respect to the second auxiliary axis B-B'. In the illustrated embodiment, the second plenum 316 is fluidly coupled to the second pre-cleaner 314 via a second intermediate conduit 424 (shown in FIG. 4). In other embodiments, the second pre-cleaner 314 may be directly coupled to the second plenum 316. In such a situation, the second intermediate conduit 424 may be omitted. The second plenum 316 has a substantially hollow, chamber like configuration. The second plenum 316 is adapted to receive the flow of intake air from the second pre-cleaner 314.

The second filter assembly 312 also includes a second air filter 320. The second air filter 320 is axially aligned with respect to the second auxiliary axis B-B'. The second air filter 320 includes a filter element (not shown) therein. The second air filter 320 is adapted to receive the flow of intake air from the second plenum 316 and provide further filtration of the flow of intake air. In the illustrated embodiment, the second air filter 320 has a substantially rectangular configuration. In other embodiments, the second air filter 320 may have any other configuration, such as cylindrical. The second air filter 320 is mounted within the enclosure 118 of the machine 100.

The air delivery system 222 also includes an air box 322. The air box 322 has a substantially hollow, hexagonal chamber like configuration. The air box 322 is fluidly coupled to each of the first air filter 310 and the second air filter 320. Accordingly, the air box 322 is adapted to receive the flow of intake air from each of the first filter assembly 302 and the second filter assembly 312. In the illustrated embodiment, the air box 322 is fluidly coupled to each of the first air filter 310 and the second air filter 320 via each of a first conduit 324 and a second conduit 326 respectively. In other embodiments, the air box 322 may be directly coupled to one or both the first air filter 310 and the second air filter 320. In such a situation, one or both the first conduit 324 and the second conduit 326 may be omitted.

Figure 5:
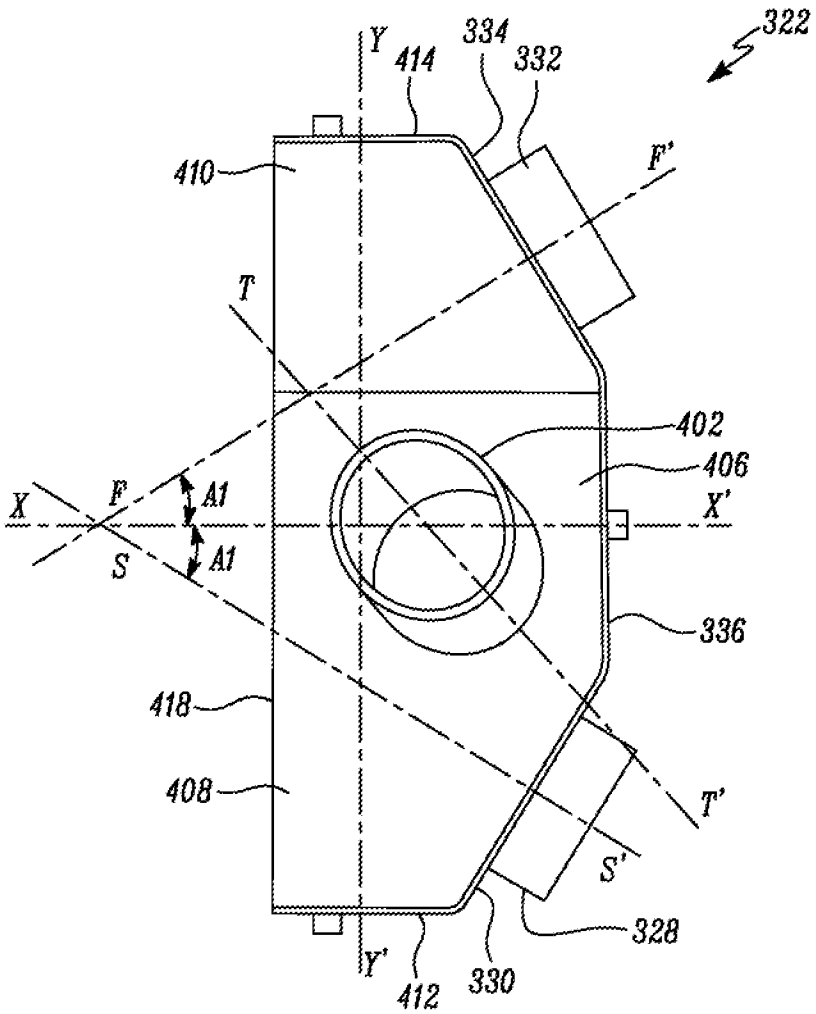
FIG. 5 is a bottom view of an air box of the air delivery system of FIG. 3, according to one embodiment of the present disclosure.
Figure 6:
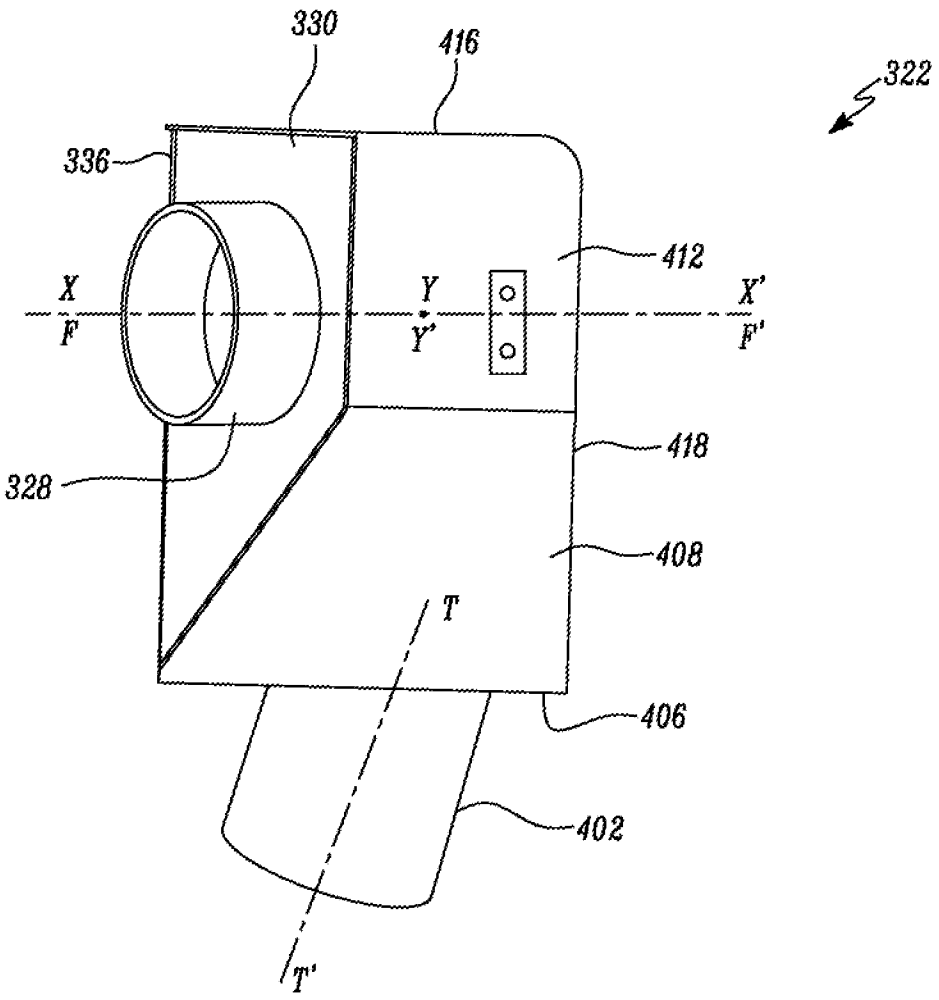
FIG. 6 is a side perspective view of the air box of FIG. 5, according to one embodiment of the present disclosure.

Referring to FIGS. 5 and 6, different views of the air box 322 are illustrated. The air box 322 will now be explained with combined reference to FIGS. 3, 4, 5, and 6. The air box 322 defines a lateral axis X-X' and a longitudinal axis Y-Y' thereof. The air box 322 includes a first inlet 328. The first inlet 328 defines a first axis F-F' of the air box 322. The first inlet 328 is provided on a first wall 330 of the air box 322. The first wall 330 is disposed substantially perpendicular with respect to the first inlet 328. The first inlet 328 is adapted to be coupled to the first conduit 324 or directly to the first air filter 310, based on application requirements.

The first inlet 328 is disposed at a first angle "A1" with respect to the lateral axis X-X'. In the illustrated embodiment, the first angle "A1" measures 60 degrees (°). In other embodiments, an actual value of the first angle "A1" may range from 55° to 65°, based on application requirements. Also, the first conduit 324 and the first air filter 310 are axially aligned with respect to the first axis F-F'. Accordingly, each of the first conduit 324 and the first air filter 310 is also disposed at the first angle "A1" with respect to the lateral axis X-X'. Further, each of the first air filter 310 and the first pre-cleaner 304 extends substantially perpendicularly with respect to each of the first axis F-F', the lateral axis X-X', and the longitudinal axis Y-Y', as shown by the first auxiliary axis A-A'.

The air box 322 also includes a second inlet 332. The second inlet 332 defines a second axis S-S' of the air box 322. The second inlet 332 is disposed substantially coplanar with respect to the first inlet 328. The second inlet 332 is provided on a second wall 334 of the air box 322. The second wall 334 is spaced apart with respect to the first wall 330, such that an intermediate wall 336 interconnects each of the first wall 330 and the second wall 334. In some embodiments (not shown), the first wall 330, the second wall 334, and the intermediate wall 336 may be substituted by a single curved wall. In yet some embodiments, the first wall 330 may be directly coupled to the second wall 334, such that the intermediate wall 336 may be omitted. Also, the second wall 334 is disposed substantially perpendicular with respect to the second inlet 332. The second inlet 332 is adapted to be coupled to the second conduit 326 or directly to the second air filter 320, based on application requirements.

The second inlet 332 is disposed at the first angle "A1" with respect to the lateral axis X-X'. In the illustrated embodiment, the first angle "A1" measures 60°. In other embodiments, an actual value of the first angle "A1" may range from 55° to 65°, based on application requirements. Also, the second conduit 326 and the second air filter 320 are axially aligned with respect to the second axis S-S'. Accordingly, each of the second conduit 326 and the second air filter 320 is also disposed at the first angle "A1" with respect to the lateral axis X-X'. Further, each of the second air filter 320 and the second pre-cleaner 314 extends substantially perpendicularly with respect to each of the second axis S-S', the lateral axis X-X', and the longitudinal axis Y-Y', as shown by the second auxiliary axis B-B'.

The air box 322 also includes an outlet 402 (shown in FIG. 4). The outlet 402 is adapted to be coupled to a third conduit 404. The outlet 402 defines a third axis T-T' of the air box 322. The outlet 402 is provided on a third wall 406 of the air box 322. The third wall 406 is disposed substantially perpendicular with respect to each of the first wall 330 and the second wall 334. Also, the third wall 406 is disposed in a plane substantially perpendicular with respect to a plane of each of the first wall 330 and the second wall 334. Accordingly, the outlet 402 is disposed in a plane substantially perpendicular with respect to a plane of each of the first inlet 328 and the second inlet 332.

Also, each of the first conduit 324, the first air filter 310, the second conduit 326, and the second air filter 320 is disposed in a plane substantially perpendicular with respect to the plane of the outlet 402. Further, each of the first air filter 310, the first pre-cleaner 304, the second air filter 320, and the second pre-cleaner 314 extends in a plane substantially parallel to and spaced apart with respect to the plane of the outlet 402. The outlet 402 is disposed at a second angle "A2" with respect to the longitudinal axis Y-Y'. In the illustrated embodiment, the second angle "A2" measures 66°. In other embodiments, an actual value of the second angle "A2" may range from 60° to 70°, based on application requirements.

Additionally, the air box 322 includes one or more angled walls, such as a first angled wall 408 and a second angled wall 410. Each of the first angled wall 408 and the second angled wall 410 is disposed at a third angle "A3" with respect to the longitudinal axis Y-Y' or the third wall 406. In the illustrated embodiment, the third angle "A3" measures 45°. In other embodiments, an actual value of the third angle "A3" may range from 40° to 50°, based on application requirements. Each of the first angled wall 408 and the second angled wall 410 is coupled to the third wall 406 and disposed in association with the outlet 402. Each of the first angled wall 408 and the second angled wall 410 is adapted to direct the flow of intake air within the air box 322 toward the outlet 402.

The air box 322 also includes a first side wall 412 and a second side wall 414. The second side wall 414 is disposed opposite the first side wall 412. In the illustrated embodiment, the first side wall 412 is disposed substantially parallel with respect to the second side wall 414. The first side wall 412 is coupled to each of the first wall 330, the first angled wall 408, a fourth wall 416, and a fifth wall 418. The second side wall 414 is coupled to each of the second wall 334, the second angled wall 410, the fourth wall 416, and the fifth wall 418. In the illustrated embodiment, each of the first side wall 412 and the second side wall 414 is disposed substantially perpendicular with respect to each of the third wall 406, the lateral axis X-X', and the longitudinal axis Y-Y'. In other embodiments, each of the first side wall 412 and the second side wall 414 may be disposed at an angle (not shown) with respect to each of the third wall 406, the lateral axis X-X', and the longitudinal axis Y-Y', based on application requirements.

The fourth wall 416 is disposed substantially parallel with respect to each of the third wall 406, the lateral axis X-X', and the longitudinal axis Y-Y'. The fifth wall 418 is disposed substantially perpendicular with respect to each of the third wall 406, the fourth wall 416, the lateral axis X-X', and the longitudinal axis Y-Y'. It should be noted that a configuration of the air box 322, as described herein, is adapted to limit or reduce restriction to the flow of intake air and direct the flow of intake air from each of the first inlet 328 and the second inlet 332 toward the outlet 402.

In other embodiments, each of the first side wall 412 and the second side wall 414 may be omitted. In such a situation, each of the first angled wall 408 and the second angled wall 410 may extend up to the fourth wall 416. Also, in some embodiments, the fourth wall 416 may be disposed at an angle (not shown) with respect to the fifth wall 418 in order to limit restriction to the flow of intake air and direct the flow of intake air toward the outlet 402. Further, in some embodiments, the fifth wall 418 may be disposed at an angle (not shown) with respect to the third wall 406 in order to limit restriction to the flow of intake air and direct the flow of intake air toward the outlet 402.

The air delivery system 222 also includes the third conduit 404. The third conduit 404 is fluidly coupled to each of the air box 322 and the engine 204. More specifically, the third conduit 404 is fluidly coupled to each of the outlet 402 and the compressor section 218 of the turbocharger 216. In a situation when the turbocharger 216 may be omitted, the third conduit 404 may be directly coupled to the intake manifold 210. The third conduit 404 is adapted to provide the flow of intake air from the air box 322 to the engine 204.

The third conduit 404 is disposed axially with respect to the third axis T-T'. Accordingly, the third conduit 404 is disposed at the second angle "A2" with respect to the longitudinal axis Y-Y'. In the illustrated embodiment, the third conduit 404 includes a bend 224 (shown in FIG. 2) provided therein. The bend 224 is adapted to couple the air box 322 to the horizontally oriented turbocharger 216. In other embodiments when the turbocharger 216 may be axially aligned with respect to the third axis T-T', the bend 224 may be omitted.

The air box 322 may be manufactured using any manufacturing process, such as fabrication, molding, additive manufacturing, and the like. The air box 322 may be manufactured using any material, such as a metal, a polymer, and/or a combination thereof. In some embodiments, the air box 322 may be manufactured using sound dampening material in order to limit sound generated by the flow of intake air through the air box 322. Additionally, the air delivery system 222 may include components (not shown), such as one or more fastening elements, coupling elements, support elements, and the like, to provide coupling/mounting of one or more components of the air delivery system 222 with respect to one another and/or on the machine 100.

INDUSTRIAL APPLICABILITY

The present disclosure relates to the air delivery system 222 for the engine 204. The air delivery system 222 includes a dual-filter configuration with the first filter assembly 302 and the second filter assembly 312. The dual filter configuration provides reduced restriction to the flow of intake air, improved filtering efficiency, improved filter life, reduced service intervals, and reduced system downtime. Further, the air delivery system 222 includes the air box 322 and the third conduit 404. Each of the air box 322 and the third conduit 404 provides optimized system orientation and is adapted to limit restriction to the flow of intake air therethrough and further toward the engine 204.

More specifically, the first angle "A1" defined by each of the first inlet 328 and the second inlet 332 with respect to the lateral axis X-X' is adapted to limit restriction to the flow of intake air from each of the first air filter 310 and the second air filter 320 toward and into the air box 322. Also, each of the first angled wall 408 and the second angled wall 410 is adapted to direct the flow of intake air within the air box 322 toward the outlet 402. In some embodiments, the fourth wall 416 and/or the fifth wall 418 may also be inclined with respect to the third wall 406 in order to direct the flow of intake air within the air box 322 toward the outlet 402.

Further, the second angle "A2" defined by the outlet 402 with respect to the longitudinal axis Y-Y' is adapted to limit restriction to the flow of intake air from the air box 322 in to the third conduit 404. The air box 322 also includes the third conduit 404 axially aligned with respect to the outlet 402 and includes the single bend 224. Accordingly, the third conduit 404 is adapted to limit restriction to the flow of intake air therethrough toward the engine 204. In a situation when the bend 224 in the third conduit 404 may be omitted, the third conduit 404 may further reduce any restriction to the flow of intake air therethrough. The limited restriction to the flow of intake air provides improved flow of the intake air into the engine 204, thus, improving combustion efficiency, fuel efficiency, overall engine performance, and reducing emission.

The air delivery system 222 provides a simple, efficient, and cost-effective method of providing the filtered flow of intake air to the engine 204 with limited restriction and pressure drop. The air delivery system 222 employs known components, such as the first pre-cleaner 304, the first plenum 306, the first air filter 310, the second pre-cleaner 314, the second plenum 316, the second air filter 320, and the like, thus, limiting system cost and complexity. Also, the air delivery system 222 may be installed or retrofitted on any engine or machine with little or no modification to the existing system, thus, providing improved system compatibility and flexibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. An air delivery system for an engine, the air delivery system comprising:

a first air filter;

a second air filter;

a first conduit provided in fluid communication with the first air filter;

a second conduit provided in fluid communication with the second air filter;

an air box provided in fluid communication with each of the first conduit and the second conduit, the air box adapted to receive flow of intake air from each of the first air filter and the second air filter, the air box defining a lateral axis and a longitudinal axis thereof; and a third conduit provided in fluid communication with the air box and the engine, the third conduit adapted to provide the flow of intake air from the air box to the engine, wherein each of the first air filter and the first conduit, and each of the second air filter and the second conduit are disposed at a first angle with respect to the lateral axis of the air box, the first angle adapted to limit restriction to the flow of intake air from each of the first air filter and the second air filter toward the air box, the first angle having a range of 55 degrees to 65 degrees, and wherein the third conduit is disposed at a second angle with respect to the longitudinal axis of the air box, the second angle adapted to limit restriction to the flow of intake air from the air box to the engine, the second angle having a range of 60 degrees to 70 degrees.

2. The air delivery system of claim 1, wherein each of the first air filter and the second air filter extends perpendicularly with respect to each of the lateral axis and the longitudinal axis of the air box.

3. The air delivery system of claim 1, wherein the air box further includes:

a first inlet provided in fluid communication with the first conduit, the first inlet disposed at the first angle with respect to the lateral axis, and a second inlet provided in fluid communication with the second conduit, the second inlet disposed at the first angle with respect to the lateral axis.

4. The air delivery system of claim 1, wherein the air box further includes an outlet provided in fluid communication with the third conduit, the outlet disposed at the second angle with respect to the longitudinal axis.

5. The air delivery system of claim 1, wherein the air box further includes:

a first wall having a first inlet disposed at the first angle with respect to the lateral axis;

a second wall having a second inlet disposed at the first angle with respect to the lateral axis;

a first side wall disposed opposite of and substantially parallel to a second side wall, the first side wall coupled to the first wall and the second side wall coupled to the second wall;

a third wall having an outlet provided in fluid communication with the third conduit, the outlet disposed at the second angle with respect to the longitudinal axis;

a first angled wall extending between the first side wall and the third wall; and a second angled wall extending between the second side wall and the third wall, wherein the first angled wall and the second angled wall are adapted to direct the flow of intake air within the air box toward the outlet.

6. The air delivery system of claim 1, wherein the third conduit further includes a bend provided therein.

7. An engine comprising;
an engine block;
a plurality of cylinders disposed within the engine block;
a cylinder head provided in association with the engine block;
an intake manifold provided in association with the cylinder head; and
an air delivery system provided in association with the intake manifold, the air delivery system including:
a first air filter;
a second air filter;
a first conduit provided in fluid communication with the first air filter;
a second conduit provided in fluid communication with the second air filter;
an air box provided in fluid communication with each of the first conduit and the second conduit, the air box adapted to receive flow of intake air from each of the first air filter and the second air filter, the air box defining a lateral axis and a longitudinal axis thereof; and
a third conduit provided in fluid communication with the air box and the engine, the third conduit adapted to provide the flow of intake air from the air box to the engine,
wherein each of the first air filter and the first conduit, and each of the second air filter and the second conduit are disposed at a first angle with respect to the lateral axis of the air box, the first angle adapted to limit restriction to the flow of intake air from each of the first air filter and the second air filter toward the air box,
wherein the third conduit is disposed at a second angle with respect to the longitudinal axis of the air box, the second angle adapted to limit restriction to the flow of intake air from the air box to the engine;
wherein the first angle has a range of 55 degrees to 65 degrees; and
wherein the second angle has a range of 60 degrees to 70 degrees.

8. The engine of claim 7, wherein each of the first air filter and the second air filter extends perpendicularly with respect to each of the lateral axis and the longitudinal axis of the air box.

9. The engine of claim 7, wherein the air box further includes:
a first inlet provided in fluid communication with the first conduit, the first inlet disposed at the first angle with respect to the lateral axis,
a second inlet provided in fluid communication with the second conduit, the second inlet disposed at the first angle with respect to the lateral axis, and
an outlet provided in fluid communication with the third conduit, the outlet disposed at the second angle with respect to the longitudinal axis.

10. The engine of claim 7, wherein the air box further includes a plurality of angled walls provided in association with the third conduit, each of the plurality of walls adapted to direct the flow of air toward the third conduit.

11. A machine comprising:
a frame;
a plurality of ground engaging members mounted to the frame;
an implement movably mounted to the frame;
an engine mounted on the frame; and
an air delivery system mounted on the frame and provided in association with the engine, the air delivery system including:
a first air filter;
a second air filter;
a first conduit provided in fluid communication with the first air filter;
a second conduit provided in fluid communication with the second air filter;
an air box provided in fluid communication with each of the first conduit and the second conduit, the air box adapted to receive flow of intake air from each of the first air filter and the second air filter, the air box defining a lateral axis and a longitudinal axis thereof; and
a third conduit provided in fluid communication with the air box and the engine, the third conduit adapted to provide the flow of intake air from the air box to the engine,
wherein each of the first air filter and the first conduit, and each of the second air filter and the second conduit are disposed at a first angle with respect to the lateral axis of the air box, the first angle adapted to limit restriction to the flow of intake air from each of the first air filter and the second air filter toward the air box,
wherein the third conduit is disposed at a second angle with respect to the longitudinal axis of the air box, the second angle adapted to limit restriction to the flow of intake air from the air box to the engine;
wherein the first angle has a range of 55 degrees to 65 degrees; and
wherein the second angle has a range of 60 degrees to 70 degrees.

12. The machine of claim 11, wherein each of the first air filter and the second air filter extends perpendicularly with respect to each of the lateral axis and the longitudinal axis of the air box.

13. The machine of claim 11, wherein the air box further includes:
a first inlet provided in fluid communication with the first conduit, the first inlet disposed at the first angle with respect to the lateral axis,
a second inlet provided in fluid communication with the second conduit, the second inlet disposed at the first angle with respect to the lateral axis, and
an outlet provided in fluid communication with the third conduit, the outlet disposed at the second angle with respect to the longitudinal axis.

14. The machine of claim 11, wherein the air box further includes a plurality of angled walls provided in association with the third conduit, each of the plurality of walls adapted to direct the flow of air toward the third conduit.

15. The air delivery system of claim 1, wherein the first angle is 60 degrees and the second angle is 66 degrees.

16. The air delivery system of claim 5, wherein the first angled wall and the second angled wall are disposed at a third angle from the longitudinal axis, the third angle having a range of 40 to 50 degrees.

17. The air delivery system of claim 16, wherein the third angle is 45 degrees.

18. The engine of claim 7, wherein the first angle is 60 degrees and the second angle is 66 degrees.

19. The machine of claim 11, wherein the first angle is 60 degrees and the second angle is 66 degrees.

* * * * *